United States Patent [19]

Metro

[11] 4,429,474

[45] Feb. 7, 1984

[54] ADJUSTABLE MECHANICALLY CUSHIONED LATERAL BORDER OF THE HEEL FOR A SHOE

[76] Inventor: Robert D. Metro, 848 Roxbury La., Noblesville, Ind. 46060

[21] Appl. No.: 336,419

[22] Filed: Dec. 31, 1981

Related U.S. Application Data

[63] Continuation-in-part of Ser. No. 313,454, Oct. 21, 1981.

[51] Int. Cl.[3] ..... A43B 21/36

[52] U.S. Cl. ..... 36/36 A; 36/42; 36/73

[58] Field of Search ..... 36/35 R, 36 R, 36 A, 36/36 C, 38, 40, 42, 15, 101, 129, 71.5, 73

[56] References Cited

U.S. PATENT DOCUMENTS

| | | | |
|---|---|---|---|
| 659,073 | 10/1900 | Keller | 36/38 X |
| 3,822,488 | 7/1974 | Johnson | 36/129 |
| 4,246,706 | 1/1981 | Persons, Jr. | 36/73 |

FOREIGN PATENT DOCUMENTS

| | | | |
|---|---|---|---|
| 335148 | 3/1921 | Fed. Rep. of Germany | 36/36 A |
| 18336 | of 1889 | United Kingdom | 36/36 C |
| 16966 | of 1906 | United Kingdom | 36/36 A |
| 23876 | of 1906 | United Kingdom | 36/36 A |

*Primary Examiner*—James Kee Chi

*Attorney, Agent, or Firm*—Barnes & Thornburg

[57] ABSTRACT

An adjustable mechanically cushioned heel for a shoe comprises a recess adjacent one of the lateral borders of the heel area and ground-engaging members removably attached to the recess. Each of the ground-engaging members includes a relatively stiff spring element to provide a cushioning effect at the one lateral border of the heel area. Independent adjustable couplings between the ground-engaging members and the recess allow the user to independently alter the spring constant of each spring element to vary the cushioning effect at the lateral border of the heel.

8 Claims, 8 Drawing Figures

ADJUSTABLE MECHANICALLY CUSHIONED LATERAL BORDER OF THE HEEL FOR A SHOE

This is a continuation-in-part of my co-pending application Ser. No. 313,454, filed Oct. 21, 1981.

This invention relates to shoe heels, and more particularly to a replaceable heel for an athletic shoe, including mechanical means for adjustably cushioning the heel.

It is common practice in the shoe industry to provide athletic shoes with integrated soles and heels. See for example, U.S. Pat. No. 4,279,083. Whenever the heel or sole wears out, the entire shoe or at least the entire sole and heel must be replaced. In many athletic shoes, and in particular running shoes, the heel area is constantly subjected to strong pressure influences causing such area to wear very rapidly relative to other areas of the shoe. Thus, owners of running shoes are often required to purchase new shoes when in fact all that is needed is a new heel area.

Because of the constant pressure influence on the heel area of a running shoe, such area is typically cushioned for shock absorption. The cushioning effect has heretofore been achieved by a relatively thick layer of foam material on the heel area. As the heel area begins to wear, the cushioning effect becomes less until insufficient cushioning remains. Conventional running shoes do not include any way for increasing the cushioning effect due to wear. One proposed solution has been to provide foam material for addition to the heel area as it begins to wear. Another solution has been to incorporate permanent wear bars or replaceable wear plugs into high-wear regions of the shoe. However, in most instances, new running shoes are purchased not because the heel area is completely worn through, but because the heel area provides insufficient cushioning. The loss of cushioning properties is potentially the most serious wear in a running shoe.

Research related to shoes has shown that running does not involve a simple back-to-front traverse of pressure on the bottom of the running shoe. Although distribution of pressure is different among runners, the existence of a common pattern has been determined. The runner's shoe first makes contact with the outside or lateral border of the heel of the shoe and not the back edge of the heel, although when walking it is quite common for the back edge of the heel to make contact with the ground first. With the lateral border of the shoe landing first, the natural tendency is for the foot to shift into a flat position whereby pressure moves immediately toward the midline of the shoe and then stays in the forefoot. Flattening of the foot after the lateral border of the heel initially strikes the ground involves movement commonly called pronation. This rolling or rotation motion creates a grinding effect, causing the outside or lateral border of the heel area to wear more rapidly than the remainder of the shoe. Heretofore, running shoes have been designed as if running was a simple back-to-front transfer of pressure, which has been shown not to be the case. While many shoes are modified at the rearmost part of the heel, very few, if any, include modifications to the lateral border of the heel which makes the initial contact with the ground.

While foot strike and subsequent ground contact of individual runners have certain features which are common in all runners, the running style pattern of ground contact and body weight of runners can be substantially different. Thus, it would be highly advantages to be able to adjust the running shoe for the physical and biomechanical characteristics of each individual runner.

As the runner's foot contacts the ground, forces and pressure many times build to a value greater than twice the runner's body weight. It would be advantageous to be able to return energy associated with these forces and pressure back to the runner.

Another disadvantage of most running shoes is that the heel area provides a predetermined amount of cushioning when the shoe is new. This may not represent a significant problem if the amount of cushioning needed by the runner is less than the predetermined amount. However, if the runner needs more cushioning, there is no way to increase the cushioning effect. Further, there is no way to maintain the predetermined cushioning effect as the rearmost and lateral border of the heel area begins to wear.

Replaceable heels for shoes have been used before. For example, U.S. Pat. No. 1,773,242 discloses a shoe with an interchangeable sole and heel. U.S. Pat. Nos. 2,802,285 and 3,271,885 also disclose replaceable heels for shoes. U.S. Pat. No. 3,742,622 is of interest because it shows a foam filled heel for an athletic shoe. However, none of these patents allow the cushioning effect of the heel area to be adjusted to compensate for individual height and weight and for wear of the heel area.

As disclosed in the above patents, even in shoes with replaceable heels, it has been the practice to provide cushioning for the heel area by using impact-absorbing material such as rubber. Applicant, on the other hand, provides mechanical means for adjustably cushioning the heel area of a shoe.

One proposed solution for an adjustable cushioning effect has been what is commonly referred to as the "air shoe." Generally speaking, these "air shoes" include one or more chambers located either in the midsole or between the midsole and the outsole of the shoe which are filled with pressurized air or other gases. In some cases, connections are provided between chambers and the connections incorporate valves to control the flow of air between the chambers. Some of the "air shoes" include a valve for inflating to a desired pressure by a pump. However, the "air shoe" has many problems. The air or gas is difficult to encapsulate without leakage, thus the shoes lose air over a period of running. The air cavity or chamber is suject to puncture by piercing through the thin outsole. Formation of the air chambers is both expensive and difficult. It is much easier and less expensive to use a foam material than to manufacture a chamber which will contain pressurized air or other gases. Furthermore, the properties of air and gases are temperature dependent. The shoe has a different cushioning effect during hot and cold weather.

One advantage obtained by the use of mechanical means such as a spring for cushioning is that the spring constant can be altered to adjust the cushioning effect. Another advantage is that the amount of cushioning which the heel provides is not influenced by temperature or dependent on the material composition of the heel. Further, the problem related to encapsulating air or gas is eliminated. The spring and the surface-engaging area of the heel can be made of two different materials so that the most desired combination of cushion and long wear can be incorporated into the heel through the proper selection of materials for the spring and the surface-engaging area.

It is therefore an object of the present invention to provide a shoe where the heel area can be adjusted for the physical and biomechanical characteristics of each individual runner and for maximizing the return of energy to the runner, from the forces and pressure which are produced when the runner's foot strikes the ground.

Another object of the present invention is to provide a heel for a shoe which can be laterally adjusted to provide a variable cushioning effect at the lateral border of the heel.

Still another object of this invention is to provide a shoe where the portion of the heal subject to the greatest wear is replaceable by the user of the shoe.

It is a further object of this invention to provide a shoe in which the cushioning effect thereof is produced by mechanical means such as a spring so that as the lateral border of the heel area becomes worn the spring constant can be altered to prolong the cushioning effect.

According to the present invention, a replaceable shoe heel includes a mechanical spring for cushioning the heel area and means for adjusting the cushioning effect at the lateral border of the heel area.

Other objects and advantages of the present invention will become apparent to those skilled in the relevant art upon consideration of the accompanying drawings illustrating the invention and showing preferred embodiments exemplifying the best mode of carrying out the invention as presently perceived.

Figure 1:
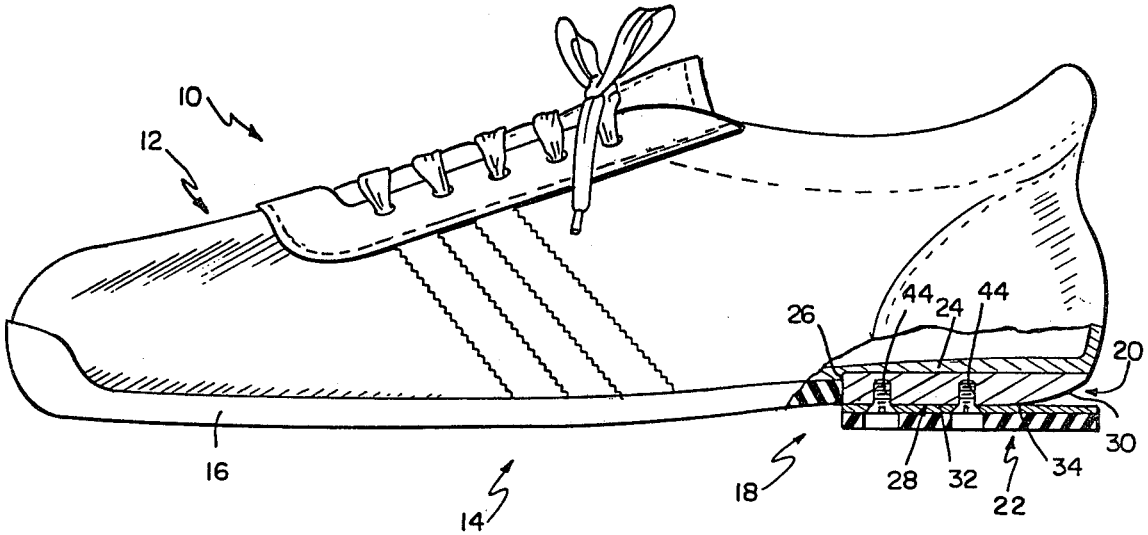
FIG. 1 is a side elevational view, partly broken away and cross-sectioned, of an athletic shoe embodying a heel constructed according to the present invention.

Referring now to FIG. 1, a shoe 10 includes an upper portion 12 and a lower portion 14. The lower portion 14 includes a sole 16 and a heel 18 embodying the present invention. The heel 18 includes a permanent heel insert 20 attached to the upper portion 12 of the shoe 10 and a replaceable ground-engaging cushioning means 22. The heel insert 20 includes an upper surface 24, a front surface 26, and a lower surface 28. The upper and front surfaces 24 and 26 fit into a recess provided in the upper portion 12 of the shoe 10 and are attached thereto by conventional means, such as glue, tacks, nails, etc. Both the upper surface 24 and the front surface 26 are relatively planar. On the other hand, the lower surface 28 includes a curved section 30 providing a lower arcuate surface and a planar section 32. As shown in FIG. 1, the sections 30 and 32 intersect or blend at a point 34. It can be appreciated that the heel insert member 20 will have generally the same shape as the rear of the upper portion 12 of the shoe 10 so that sides of the heel insert 20 will generally conform to the contour of the rear of the upper portion 12. In some instances, the heel insert 20 may have sides which flare outwardly to provide a wider base for the ground-engaging member 22. In the preferred embodiment, the heel insert 20 is fabricated from a lightweight rigid material, such as plastic or aluminum, in order to minimize the weight of the shoe. However, other materials can be used to construct the heel insert 20 without departing from the scope of the invention.

Figure 2:
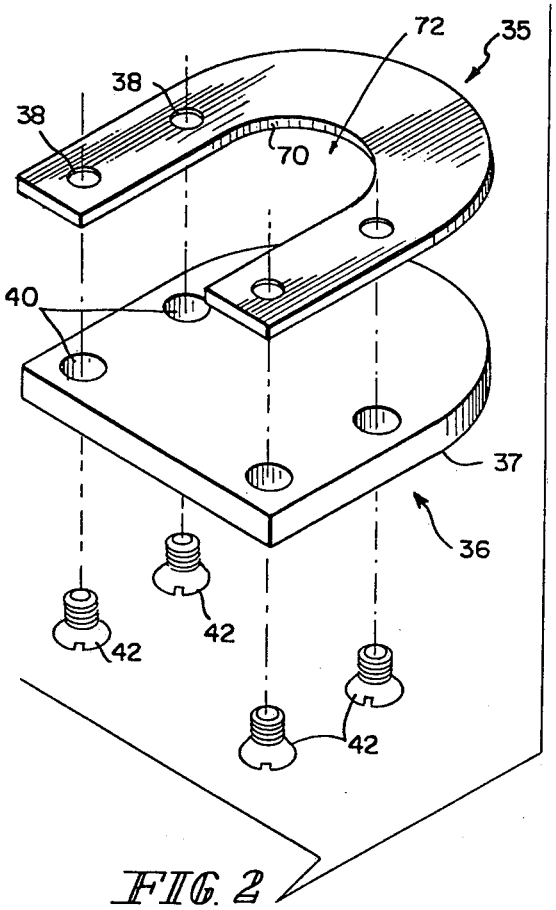
FIG. 2 is an exploded perspective view of a portion of the heel structure shown in FIG. 1.

Referring to FIG. 2, the cushioning means 22 of the heel 18 includes a generally U-shaped flexible member 35 and a generally D-shaped ground-engaging heel sole 36. In the preferred embodiment, the flexible member 35 is made of relatively stiff spring steel having sufficient flexibility to provide a cushioning effect in the heel area of the shoe 10 when flexed at a fulcrum point 34. In the preferred embodiment, the ground-engaging heel sole 36 is made of a soft cushioning material such as rubber which provides an additional cushioning effect between the flexible member 35 and the ground and provides traction between the ground surface and the heel 18. If so desired, the lower surface 37 of the heel sole 36 can include ridges, cleats, or other surface configurations normally used to aid traction. It should be noted that both the flexible member 35 and the heel sole 36 are relatively thin so as not to add an appreciable thickness to the heel area of the shoe 10.

The flexible member 35 includes apertures 38 which align with apertures 40 provided in the heel sole 36. The flexible member 35 and heel sole 36 are secured together by conventional means, such as glue or other adhesive materials, to form a replaceable heel cushioning unit 22 which in turn is removably attached to the heel insert 20. The heel cushioning unit 22 is attached to the heel insert 20 by screws 42. Screws 42 are threadably received in threaded slots 44 formed in the heel insert 20, as shown in FIG. 1. As best seen in FIG. 1, the heads of the screws 42 are recessed in the heel sole 36 so that they do not engage the ground surface.

Figure 3:
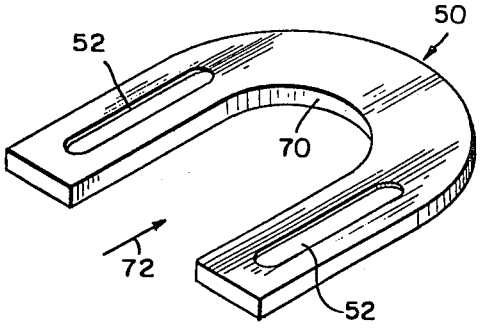
FIG. 3 is a perspective view of another embodiment of one of the two sections of the heel portion shown in FIG. 2.

Referring now to FIG. 3, another embodiment of a flexible member 50 is shown. Flexible member 50 is also made of relatively stiff spring steel. Flexible member 50 includes slots 52 in place of discrete apertures 38. It can be appreciated that if the flexible member 50 includes elongated slots 52, then the heel sole 36 will also include corresponding elongated slots. The use of slots instead of apertures achieves the advantage of enabling the user to adjust the cushioning means 22 forward and rearward on the heel insert 20. This forward and rearward adjustment alters the spring constant of the flexible member 50 by changing the amount of the member 50 extending rearwardly from point 34 under the arcuate surface 30 of the heel insert 20. Therefore, the cushioning effect of the spring-loaded cushioning unit 22 can be adjusted for individual size, weight, and personal preference, and to maintain a generally constant cushioning effect during prolonged use of the shoe 10. By moving the cushioning unit 22 rearward, the spring constant of the flexible member 50 becomes less and therefore more flexible, thereby reducing the cushioning effect. By moving the unit 22 forward, the spring constant of the flexible member 50 is increased, and is therefore less flexible, thereby increasing the cushioning effect. When the ground-engaging heel sole 36 wears out, the unit 22 can be removed from the heel insert 20 and a new cushioning unit 22 secured to the insert 20.

Figure 4:
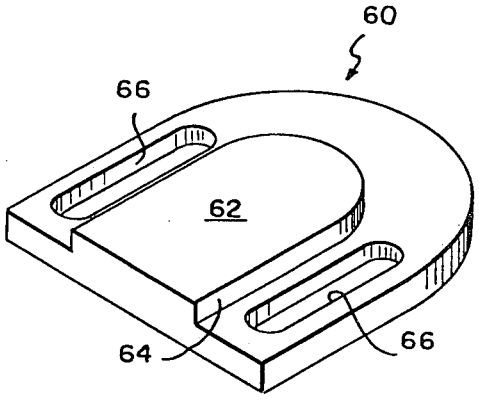
FIG. 4 is a perspective view of another embodiment of the other of the two sections of the heel portion shown in FIG. 2.
Figure 5:
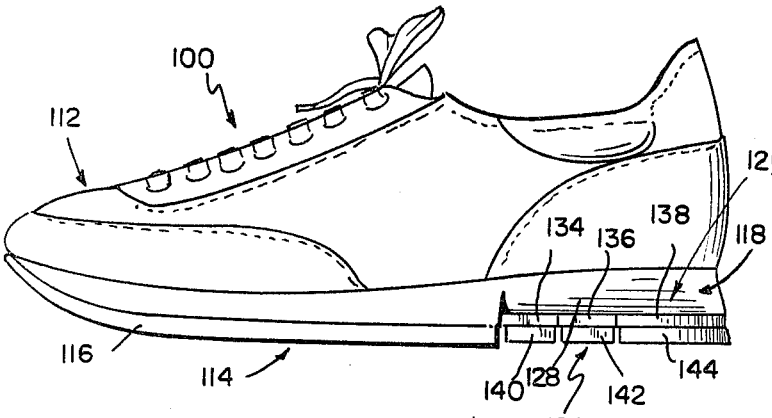
FIG. 5 is an elevational view of the outer side of an athletic shoe embodying of a heel constructed according to the present invention.

Referring now to FIG. 4, an alternate embodiment of a heel sole 60 is shown. Heel sole 60 includes a D-shaped ridge 62 having an outer edge 64. When the heel sole 60 is secured to either the flexible member 35 or 50, the outer edge 64 is contiguous with the inner surface 70 of the flexible member (35 or 50). Preferably, the ridge 62 is of approximately the same thickness as the flexible member (35 or 50). The ridge 62 is useful in aligning the heel sole 60 relative to the flexible member 35 or 50. The ridge 62 also serves to fill the open area 72 provided in the generally U-shaped flexible member 35 or 50. The heel sole 60 may include apertures or slots 66 depending upon the flexible member 34 or 50, respectively, and is secured to the flexible member 34 or 50 by conventional means, such as glue or other adhesive material.

Figure 6:
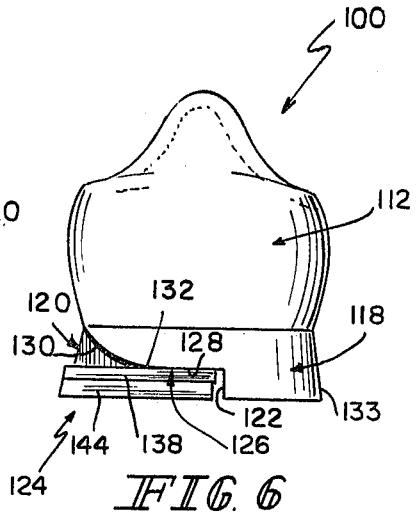
FIG. 6 is an elevational view of the back of the athletic shoe and heel structure, shown in FIG. 5.
Figure 7:
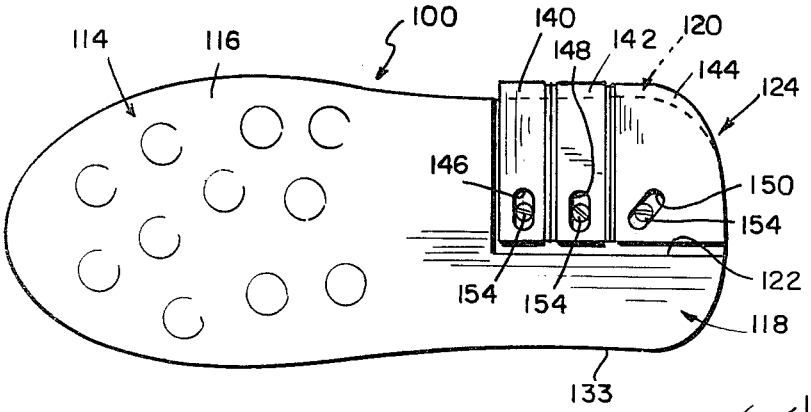
FIG. 7 is an elevational view of the bottom of the athletic shoe and heel structure shown in FIG. 5.
Figure 8:
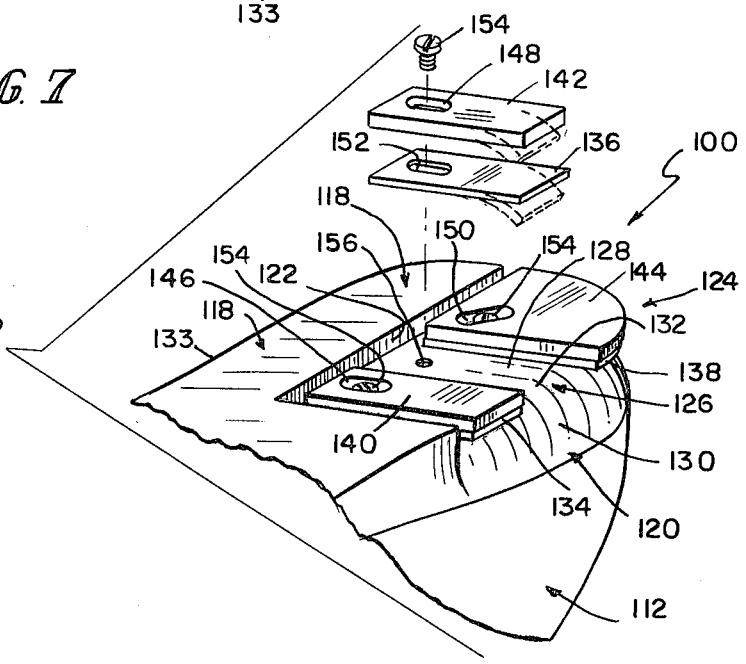
FIG. 8 is an exploded perspective view of the heel structure shown in FIGS. 5–7.

Referring now to FIGS. 5–8, another shoe 100 embodying the present invention includes an upper portion 112 and a lower portion 114. The lower portion 114 includes an outer sole 116 and another embodiment of a heel 118 constructed according to the present invention. The heel area 18 has an outside or lateral border 120 and includes a recess 122 and a replaceable ground-engaging cushioning means 124. The ground-engaging cushioning means 124 extends along the lateral border 120 of the heel area 118. The recess 122 includes a surface 126 having a planar section 128 and a curved section 130 providing an arcuate surface between the planar section 128 and the lateral border 120 of the heel area 118. As shown in FIGS. 6 and 8, the sections 128 and 130 intersect or blend at a point 132. The recess 122 and the surface 126 extend longitudinally along the heel area 118 and transversely slightly past the midline of the heel area 118. Thus, the inside border 133 of the heel area 118 remains unchanged.

Continuing to refer to FIGS. 5–8, the cushioning means 124 of the heel 118 includes three independently adjustable flexible members 134, 136, and 138, each having a ground-engaging sole 140, 142, and 144, respectively. In the preferred embodiment, each flexible member 134, 136, and 138 is made of relatively stiff spring steel having sufficient flexibility to provide a cushioning effect at the lateral border 120 of the heel area 118 of the shoe 100 when flexed at a fulcrum point 132. In the preferred embodiment, each ground-engaging heel sole 140, 142, and 144 is made of a soft cushioning material such as rubber which provides an additional cushioning effect between the flexible members 134, 136, and 138 and the ground and provides traction between the ground surface and the heel 118. If so desired, the lower surface of the heel soles 140, 142, and 144 can include ridges, cleats, or other surface configurations normally used to aid traction. It should be noted that both the flexible members 134, 136, and 138 and the heel soles 140, 142, and 144 are relatively thin so as not to add an appreciable thickness to the lateral border 120 of the heel area 118 of the shoe 100.

Each flexible member 134, 136, and 138 includes and elongated slot 146, 148, and 150 which aligns with apertures 152 provided in the heel soles 140, 142, and 144, as best shown in FIG. 8. The flexible members 134, 136, and 138 and heel soles 140, 142, and 144 are secured together by conventional means, such as glue or other adhesive materials, to form three independently replaceable heel cushioning units 124 which in turn are removably attached to the heel area 118 in recess 122. The heel cushioning units 124 are attached to the heel recess 122 by screws 154. Screws 154 are threadably received in threaded apertures 156 formed in the heel recess 122, as shown in FIG. 8. As shown in the figures, the heads of the screws 154 are recessed in the heel soles 140, 142, and 144 so that they do not engage the ground surface.

As shown in FIGS. 7 and 8, the flexible members 134 and 136 and their corresponding heel soles 140 and 142 are generally rectangular shaped. Slots 146 and 148 extend lengthwise in the flexible members 134 and 136 to allow movement thereof generally perpendicular to the lateral border 120 of the heel area 118. Flexible member 138 and heel sole 144 are larger than members 134 and 136 and curved so that they correspond to the curvature of the heel area 118 joining the lateral border 120 to the rear of the heel area 118. Slot 150 extends angularly at generally 45° or less relative to the other slots 146 and 148 to all some rearward as well as lateral movement of the member 133. As previously discussed, the portion of the heel area 118 including member 138 and sole 144 is the first portion to make ground contact during running and is therefore subject to the greatest wear.

The use of slots 146, 148, and 150 instead of discrete apertures achieves the advantage of enabling the user to independently adjust members 134 and 136 laterally and to adjust member 138 laterally and rearwardly. This lateral and reaward adjustment alters the spring constant of the flexible members 134, 136, and 138 by changing the amount of the members 134, 136, and 138 extending laterally from point 132 under the arcuate surface 130 of the heel recess 122. Therefore, the cushioning effect of the spring-loaded cushioning units 124 can be adjusted for individual size, weight, and personal preference, and to maintain a generally constant cushioning effect during prolonged use of the shoe 100. Furthermore, adjustment laterally relative to the outside border 120 of the heel area 118 maximizes the cushioning effect at that portion of the heel area 118 which first strikes the ground when running, thus increasing the amount of energy returned to the runner. By moving the cushioning units 124 laterally outwardly, the spring constants of the flexible members 134, 136, and 138 become less and therefore more flexible, thereby reducing the cushioning effect. By moving the units 124 laterally inwardly, the spring constants of the flexible members 134, 136, and 138 are increased, and are therefore less flexible, thereby increasing the cushioning effect. When one or more of the ground-engaging heel soles 140, 142, and 144 wear out, the affected unit 124 can be removed from the heel area 118 and a new cushioning unit 124 secured in the recess 122.

While the embodiments described above are presently the best perceived mode of carrying out the invention, other mechanical means for providing cushioning in the heel area of a shoe and for adjusting the cushioning effect thereof may be employed without departing from the scope of the present invention.

What is claimed is:

1. In a shoe including an upper portion and a lower portion having a sole and a heel area, the heel area having lateral and rear borders and spring-loaded means for cushioning the heel area, the improvement wherein the heel area includes a generally planar surface near the center of the heel area and an arcuate surface extending laterally outwardly and upwardly therefrom, the spring-loaded means includes at least one flexible cushioning member extending laterally generally parallel to the planar surface of the heel area, the planar and arcuate surfaces of the heel area providing a fulcrum at the lateral border for flexion of a distal portion of the cushioning member to produce a cushioning effect, and adjustment means for varying the cushioning effect of the spring-loaded means at the lateral border, the adjustment means including at least one elongated slot in the cushioning member and means received in the slot for securing the cushioning member to the heel area, the slot allowing the cushioning member to be moved laterally relative to the fulcrum at the lateral border of the heel area to change the spring constant of the distal portion thereof.

2. The improvement of claim 1 wherein the cushioning member includes a relatively stiff spring steel plate, a layer of cushioning material, and means for securing the layer of cushioning material to the plate.

3. The improvement of claim 2 wherein the spring-loaded means includes at least two flexible cushioning members, the two cushioning members being independently adjustable, one cushioning member is generally rectangular shaped and includes an elongated slot extending transverse to the heel area of the shoe to allow lateral movement thereof, the other cushioning member has a curved outer edge corresponding to the curvature of the heel area between the lateral and rear borders and includes an elongated slot extending angularly to all lateral and rearward movement thereof.

4. The improvement of claim 3 wherein the spring-loaded means further includes a second generally rectangular-shaped cushioning member, the second rectangular-shaped cushioning member includes an elongated slot extending transverse to the heel area of the shoe to allow lateral movement thereof independent of the other cushioning members.

5. The improvement of claim 4 wherein the heel area includes a recess at the outside lateral border thereof, the recess providing the planar and arcuate surfaces, and the cushioning members are movable laterally relative to the outside border to vary the cushioning effect of the heel area at the outside border.

6. In a shoe including an upper portion and a lower portion having a sole and a heel area, the improvement comprising an adjustable mechanically cushioned lateral border of the heel area, the lateral border including a recess providing a fulcrum, a plurality of ground-engaging members, and means for independently coupling each of the ground-engaging members to the recess so that distal portions thereof extend beyond the fulcrum, each ground-engaging member including a flexible spring element providing a cushioning effect, the coupling means including means for independently altering the spring constant of each spring element to vary the cushioning effect, the means for altering the spring constant including at least one elongated slot in each ground-engaging member to allow movement thereof with respect to the fulcrum, and means received in each slot for securing the ground-engaging member to the recess.

7. The improvement of claim 6 wherein the recess includes a surface having a planar region, an arcuate region extending laterally to the lateral border, and a flexion point joining the planar and arcuate regions, each spring element is generally planar and extends laterally generally parallel to the planar region of the recess, the flexion point joining the planar and arcuate regions serving as the fulcurm for flexion of the spring elements.

8. In a shoe including an upper portion and a lower portion having a sole and a heel area, the heel area having lateral and rear borders, the improvement comprising a generally planar spring element for cushioning the heel area, the lateral border of the heel area including means providing a fulcrum for flexion of the spring element, means for coupling the spring element to the heel area so that a portion of the spring element extends laterally beyond the fulcrum to cushion the lateral border of the heel area, and adjustment means for varying the length of the portion of the spring element which extends laterally beyond the fulcrum to alter the spring constant and vary the cushioning effect thereof.

* * * * *